US006520155B1

(12) United States Patent
Boecking

(10) Patent No.: US 6,520,155 B1
(45) Date of Patent: Feb. 18, 2003

(54) COMMON RAIL

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/857,577

(22) PCT Filed: Sep. 29, 2000

(86) PCT No.: PCT/DE00/03401

§ 371 (c)(1),
(2), (4) Date: Sep. 5, 2001

(87) PCT Pub. No.: WO01/25617

PCT Pub. Date: Apr. 12, 2001

(30) Foreign Application Priority Data

Oct. 7, 1999 (DE) ..... 199 48 341

(51) Int. Cl.[7] ..... F02M 55/02
(52) U.S. Cl. ..... 123/456; 123/468
(58) Field of Search ..... 123/456, 468, 123/469

(56) References Cited

U.S. PATENT DOCUMENTS 4,899,712 A * 2/1990 De Bruyn et al. ..... 123/468
5,862,995 A * 1/1999 Wu ..... 239/533.2
6,223,726 B1 * 5/2001 Jung et al. ..... 123/468

FOREIGN PATENT DOCUMENTS

| | | | |
|---|---|---|---|
| DE | 196 03 435 A1 | 8/1996 | |
| DE | 197 44 762 A1 | 10/1998 | |
| DE | 197 47 736 C1 | 4/1999 | |
| JP | 7-91347 * | 4/1995 | ..... F02M/63/00 |

* cited by examiner

*Primary Examiner*—Tony M. Argenbright
(74) *Attorney, Agent, or Firm*—Ronald E. Greigg

(57) ABSTRACT

The invention relates to a common rail for a common rail fuel injection system of an internal combustion engine, having a tubular base body which is equipped with a plurality of connection openings. To enable the common rail to withstand higher pressures than conventional common rails, according to our embodiment at least two connection openings are disposed diametrically opposite one another in the tubular base body. In a further version of the invention, diametrically opposite at least one of the connection openings, there is a machining opening, which is closed by a closure plug.

12 Claims, 2 Drawing Sheets

COMMON RAIL

CROSS-REFERENCE TO RELATED APPLICATIONS

This application is a 35 USC 371 application of PCT/DE 00/03401 filed on Sep. 29, 2000.

BACKGROUND OF THE INVENTION

1. Field of the Invention

The invention relates to a common rail for a common rail fuel injection system of an internal combustion engine, having a tubular base body which is equipped with a plurality of connection openings.

2. Description of the Prior Art

In common rail injection systems, a high-pressure pump, optionally with the aid of a prefeed pump, pumps the fuel to be injected from a tank into the central high-pressure fuel reservoir, which is called a common rail. From the rail, fuel lines lead to the individual injectors, which are assigned to the engine cylinders. The injectors are triggered individually by the engine electronics as a function of the engine operating parameters, in order to inject fuel into the combustion chamber of the engine. The pressure generation and the injection are decoupled from one another by the common rail.

A conventional common rail is described for instance in German Patent Disclosure DE 195 48 611. The conventional common rails withstand pressures of up to about 1100 bar.

SUMMARY OF THE INVENTION

The primary object of the invention is to furnish a common rail of the type described above that withstands higher pressures than conventional common rails. In addition, the common rail according to the invention should be simple in construction, and it should be possible to produce it economically.

In a common rail for a common rail fuel injection system of an internal combustion engine, having a tubular base body which is equipped with a plurality of connection openings, this object is attained in that at least two connection openings, or a connecting opening and a machining opening, are disposed diametrically opposite one another in the tubular base body. With the context of the present invention, it has been found that the high-pressure strength of the common rail is limited primarily by the intersections between the connection openings and the tubular base body. The diametrically opposed connection openings provide easy access for a machining tool. This simplifies machining the interfaces between the connection openings and tubular base body considerably. The transitions between the connection openings and the tubular base body can be rounded much more simply than in conventional common rails. The common rail of the invention withstands pressures of over 2000 bar. The best results are obtained if all the connection openings are disposed in pairs of diametrically opposed openings.

In a common rail for a common rail fuel injection system of an internal combustion engine, having a tubular base body which is equipped with a plurality of connection openings, the above-stated object is also attained in that diametrically opposite at least one of the connection openings, there is a machining opening, which is closed by a closure plug. The additional machining openings offer the advantage that the location of the connection openings can be selected freely. Through the machining opening diametrically opposite the connection opening, the critical interface between the connection opening and the tubular base body is reached more easily with a machining tool. After the machining of the connection opening, the diametrically opposed machining opening is closed with the closure plug. The machining of the transition between the machining opening and the tubular base body is logically done through the opposed connection opening. Examples of machining methods are rounding and smoothing using profiling cutters or grinders, by introducing intrinsic pressure stresses into the critical regions with the aid of a fitting that is pressed into the critical regions, by hydrogrinding processes, or by electrochemical erosion. The requisite machining of the machining opening for high-pressure strength can also be effected by the machining opening itself. The best results are obtained if one machining opening is disposed diametrically opposite each of the connection openings, or a further connection opening is disposed diametrically opposite each of the connection openings.

In one embodiment of the invention, the closure plug is formed of a memory material, in particular a metal memory material.

In another embodiment of the invention the closure plug is equipped with a thread that cooperates with a complimentary thread on the machining opening. It is understood that it is also possible to secure the closure plug in the associated machining opening in a manner proof against high pressure with the aid of a welded connection.

A further embodiment of the invention is characterized in that means for securing the common rail to the engine are provided on the closure plug. This simplifies the construction and production of the common rail considerably.

A further embodiment of the invention is characterized in that the machining openings have a larger diameter than the connection openings. This improves the accessibility for a machining tool. The applies both to machining the connection openings and to machining the machining bores themselves.

BRIEF DESCRIPTION OF THE DRAWINGS

Further objects and advantages of the invention will become apparent from the ensuing description, taken in conjunction with the drawings, in which.

DESCRIPTION OF THE PREFERRED EMBODIMENTS

Figure 1:
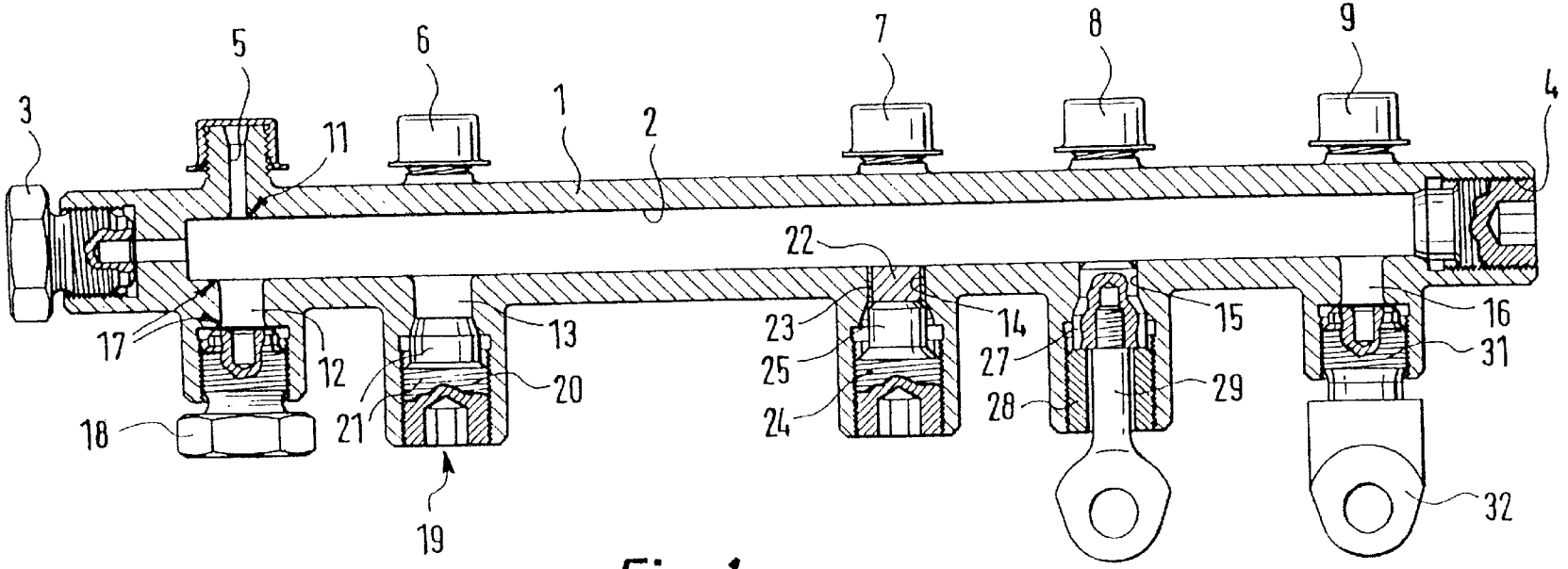
FIG. 1 shows a common rail in various embodiments of the present invention in longitudinal section.

The common rail shown in longitudinal section in FIG. 1 includes a tubular base body 1. An axial through bore 2 is recessed out of the tubular base body 1. The open ends of the through bore 2 in the tubular base body 1 are closed by closure elements or plugs 3 and 4.

Five radial connection bores 5, 6, 7, 8 and 9 discharge into the axial through bore 2 of the tubular base body 1. It can be seen from the radial connection bore 5 that the diameter of the connection bores 5–9 is relatively small in comparison to the diameter of the axial through bore 2 in the tubular base body 1. As a result, the transition 11 between the connection bore 5 and the axial through bore 2 in the tubular base body 1 is only poorly accessible to a machining tool. To achieve adequate high-pressure strength, however, it is necessary that the transition 11 between the connection bore 5 and the axial through bore 2 be rounded and smoothed.

To create access for a machining tool, machining bores 12–16 are disposed diametrically opposite the connection bores 5–9. The machining opening 12 has a markedly greater diameter than the connection bore 5. As a result, it is easily possible on the one hand to round the places 17 using a machining tool. Furthermore, the machining bore 12 furnishes simple access for a machining tool to the critical place 11, in terms of high-pressure strength, in the tubular base body 1. The machining bore 12 is closed in a manner proof against high pressure with a flat seat by means of a closure screw 18.

The machining bore 13 is closed by a closure screw 19. A conical sealing face is embodied on the closure screw 19 and cooperates with a conical seat that is embodied in the machining bore 13. The closure screw 19 can be in one piece as at 20 or in two pieces as at 21.

The machining bore 14 is closed with the aid of a closure plate 22, which is welded into the machining bore 14. The weld seam is indicated at 23. For relief of the welded connection in operation, a screw 24 is in contact with a pressure piece 25 on the side of the closure plate 22 remote from the axial through bore 2.

The machining bore 15 is closed via a sealing body 27. A conical sealing face is embodied on the sealing body 27 and cooperates with a conical seat embodied on the machining bore 15, so that the machining bore 15 can be closed in a manner proof against high pressure. The sealing body 27 is kept in contact with the conical seat by a hollow screw 28. There is also a blind bore with a female thread in the sealing body 27.

The blind bore with the female thread serves to receive a fastening eyelet 29, which extends through the hollow screw 28 and is screwed into the blind bore in the sealing body 27. Twisting the fastening eyelet 29 makes it possible to establish the correct position for mounting upon installation of the common rail in the engine.

The machining bore 16 is closed by a closure screw 31. The closure screw 31 is in one piece with a mounting eyelet 32. The mounting eyelet 32 can be machined retroactively, in order to make the correct position of the mounting eyelet 32 relative to the engine possible.

In the common rail shown in FIG. 1, various embodiments of the present invention are shown as examples. Opposite each of the connection bores 5–9, there is a machining bore 12–16. After the machining, the machining bores are closed in a manner proof against high pressure. The high-pressure strength of the common rail of the invention is enhanced considerably by the machining of the transition from the axial through bore 2 to the connection bores 5–9.

In the common rail of the invention, one machining bore is made opposite each connection bore, or wherever machining can best be done.

Figure 2:
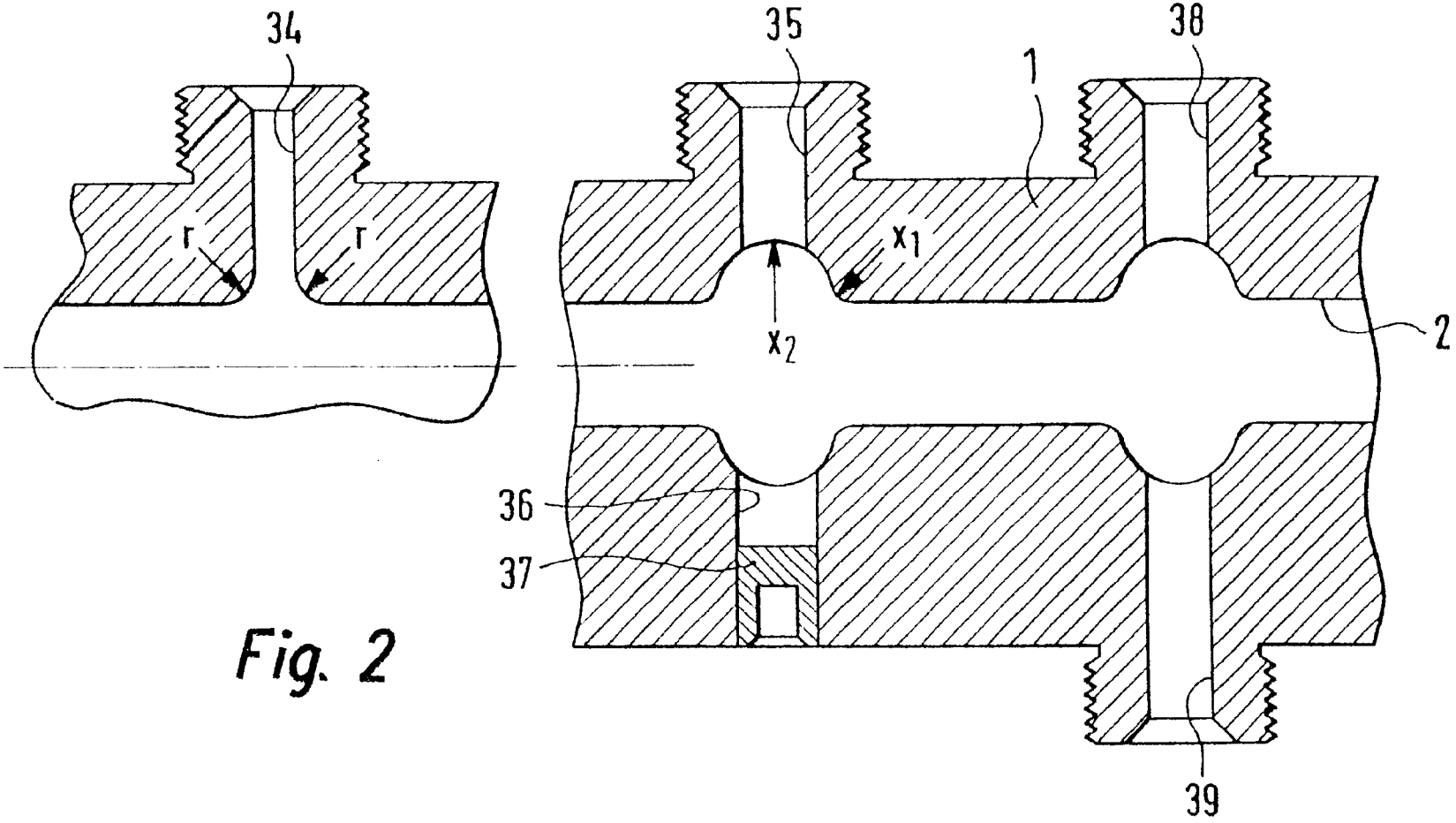
FIG. 2 shows a detail of a common rail in accordance with further embodiments of the present invention, in longitudinal section.

In FIG. 2, details of further embodiments of a common rail of the invention are shown. As in the common rail shown in FIG. 1, an axial through bore 2 is recessed out of a tubular base body 1.

A radial connection bore 34 is rounded by electrochemical erosion at its transition to the axial through bore 2. The radii of this rounding are marked "r".

A radial connection bore 35 is machined with mechanical machining tools at the transition to the axial through bore 2; these tools can be introduced through a machining bore 36 disposed diametrically opposite. The machining radii at the place of intersection between the radial connection bore 35 and the axial through bore 2 are marked $x_1$ and $x_2$. The machining bore 36 opposite the radial connection bore 35 is closed by a closure plug 37 of a memory metal. The closure plug 37 of memory metal is brought to a low temperature for insertion into the machining bore 36. Once the closure plug 37 heats up to ambient temperature again after insertion into the machining bore 36, it expands and closes the machining bore 36 in a manner proof against high pressure.

A further radial connection bore 38 discharges into the axial through bore 2 of the tubular base body 1. Opposite the radial connection bore 38, a further radial connection bore 39 is provided. The connection bores 38 and 39 are rounded at the transitions to the axial through bore 2 in the same way as the radial connection bore 35. The machining tools required for rounding the bore intersections are each introduced through the diametrically opposed connection bore. As a result, simple rounding of the transitions is made possible. The fuel reservoir of the invention represents an economical version that is suited for high pressures.

The foregoing relates to preferred exemplary embodiments of the invention, it being understood that other variants and embodiments thereof are possible within the spirit and scope of the invention, the latter being defined by the appended claims.

I claim:

1. A common rail for a common rail fuel injection system of an internal combustion engine, comprising a tubular base body (1) and a plurality of connection openings (5–9), a machining opening diametrically opposite at least one of said connection openings (5–9), and a closure plug (18, 19, 24, 27, 31) closing each said at least one machining opening, further comprising means (29, 32) for mounting the common rail to the engine being provided on the closure plug (28, 31).

2. The common rail of claim 1, wherein said closure plug (37) is formed of a metal memory material.

3. The common rail of claim 2, wherein said machining openings (12–16) have a larger diameter than said connection openings (5–9).

4. The common rail of claim 1, wherein said closure plug (18) is equipped with a thread that cooperates with a complimentary thread on said machining opening (12).

5. The common rail of claim 4, wherein said machining openings (12–16) have a larger diameter than said connection openings (5–9).

6. The common rail of claim 1, wherein at least two of said connection openings are disposed diametrically opposite one another in the tubular base body (1).

7. A common rail for a common rail fuel injection system of an internal combustion engine, comprising a tubular base body (1) and a plurality of connection openings (5–9), a machining opening diametrically opposite at least one of said connection openings (5–9), and a closure plug (18, 19, 24, 27, 31) closing each said at least one machining opening, and wherein said machining openings (12–16) have a larger diameter than said connection openings (5–9).

8. The common rail of claim 7, further comprising means (29, 32) for mounting the common rail to the engine being provided on the closure plug (28, 31).

9. The common rail of claim 7, wherein at least two of said connection openings are disposed diametrically opposite one another in the tubular base body (1).

10. The common rail of claim 9, further comprising means (29, 32) for mounting the common rail to the engine being provided on the closure plug (28, 31).

11. The common rail of claim 7, wherein said closure plug (37) is formed of a metal memory material.

12. The common rail of claim 7, wherein said closure plug (18) is equipped with a thread that cooperates with a complimentary thread on said machining opening (12).

* * * * *